United States Patent [19]

Kunz

[11] Patent Number: 4,889,494

[45] Date of Patent: Dec. 26, 1989

[54] DEVICE FOR TRANSMISSION OF ELECTRICAL CURRENTS AND ROTATING MACHINE PARTS

[75] Inventor: Anton Kunz, Triesenberg, Fed. Rep. of Germany

[73] Assignee: Balzers Aktiengesellschaft, Furstentum, Liechtenstein

[21] Appl. No.: 122,117

[22] Filed: Nov. 17, 1987

[30] Foreign Application Priority Data

Nov. 21, 1986 [CH] Switzerland ..... 04674/86

[51] Int. Cl.[4] ..... H01R 39/00

[52] U.S. Cl. ..... 439/13; 118/730; 204/297 W; 384/246

[58] Field of Search ..... 439/13, 17; 118/727, 118/730; 204/192.1, 192.12, 298 WH; 384/246, 277

[56] References Cited

U.S. PATENT DOCUMENTS

| | | | |
|---|---|---|---|
| 1,832,488 | 11/1931 | Larrabee | 384/246 |
| 2,545,939 | 3/1951 | Breitenstein | 174/21 |
| 2,997,979 | 8/1961 | Tassara | 118/730 |
| 3,408,982 | 11/1968 | Capita | 118/730 |
| 4,336,974 | 6/1982 | Wilson | 439/13 |
| 4,356,073 | 10/1982 | McKelvey | 204/192.12 |
| 4,468,069 | 8/1984 | Meal et al. | 219/471 |
| 4,525,264 | 6/1985 | Hoffman | 204/192.12 |

FOREIGN PATENT DOCUMENTS

| | | |
|---|---|---|
| 408576 | 1/1925 | Fed. Rep. of Germany . |
| 2926294 | 1/1981 | Fed. Rep. of Germany . |
| 3019118 | 11/1981 | Fed. Rep. of Germany . |
| 2006429 | 12/1969 | France . |
| 1077630 | 8/1967 | United Kingdom . |

*Primary Examiner*—Gary F. Paumen
*Attorney, Agent, or Firm*—McGlew & Tuttle

[57] ABSTRACT

A current-conducting bearing or contact bearing includes contact-making surfaces of a bearing bolt and a shaft fashioned as an axial cone and a hollow cone, respectively. With a suitable choice of materials of the current conducting parts, such as special bronzes, an allowable current load of up to 200 amperes per square cm is possible, compared to 4 amperes per square cm in the case of hard carbon and 25–30 amperes per square cm in the case of bronze carbon of traditional brushes in slip rings of electric machines.

14 Claims, 6 Drawing Sheets

DEVICE FOR TRANSMISSION OF ELECTRICAL CURRENTS AND ROTATING MACHINE PARTS

BACKGROUND OF THE INVENTION

1. Field of the Invention

The invention particularly concerns a device for transmission of electrical currents to rotating machine parts, especially rotating substrate carriers in process chambers, as well as the application of such devices.

In the conventional contact-making arrangements for rotating shafts, a slip ring arrangement is placed on the rotor shaft. This produces a relatively large diameter of the contact-making tracks with a high circumferential velocity and, thereby, considerable wear and tear on the carbon brushes. Such arrangements employ either drum slip rings, situated alongside each other on the rotor shaft, or plane slip rings, which are arranged on the end of the rotor shaft or alongside each other on an insulating carrier disk. A disadvantage of plane slip rings is the fact that, owing to the different diameters of the slip tracks, the carbon brushes are also subjected to considerable wear. These disadvantages are further intensified if the contact-making devices are required to operate without lubrication, as is the case with arrangements in vacuum process chambers or when operating at high temperatures (see German Publication 29 26 294 and German Publication 30 19 118).

SUMMARY OF THE INVENTION

The object of the invention is to reduce the diameter of the contact-making track in a contact-making arrangement or a current-conducting bearing for rotating shafts, without thereby reducing the current-conducting properties such as the current density in the arrangement. In addition, the arrangement should exhibit properties which enables an application in vacuum and at elevated temperatures.

A device in accordance with the invention includes contact-making surfaces of the device which intermesh in the form of a cone and hollow cone, and have major axes which coincide with that of the rotating part, and include a hollow conical recess which has a larger conical angle than the conical tip of the counterpart.

The invented arrangement has the advantage over the state of the art of the declared arrangements that it reduces the contact-making surfaces of the bolt defining one contact element and the shaft defining the other. As this diminishes the circumferential velocity of the rubbing surfaces, the wear on these surfaces is also lessened and, thus, the life time of the contact-making arrangement is prolonged. The measures indicated in the subordinate claims, furthermore, enable additional advantageous developments and improvements of the device specified in the principal claim.

Especially advantageous is the circumstance that the device in a vertical arrangement functions both as contact-making arrangement and as bearing, the proper weight of the rotor producing the electrical contact in one design alternative. In a horizontal application of the device, the function is restricted to the conduction of electric current and the function of a bearing must be taken over by a special bearing. An electrically insulating configuration of this contact bearing offers the further advantage that the connection cables from the contact-making arrangement to the rotor winding can be easily laid inside a bore of the shaft with no problem, thereby being protected against external influences and damage.

It has proven to be advantageous to have the contact-making surfaces of the device in the shape of a cone and a hollow cone. The rotational axes of these parts coincide with the axis of the rotating shaft. In a special configuration, the invented bearing can be designed such that:

(a) the bearing bolt has an axially arranged conical tip;

(b) the shaft (3) has an axially arranged hollow conical recess;

(c) in which the conical tip of the bearing bolt engages.

Another configuration of the invented bearing has the following individual features:

(a) the bearing bolt has an axially arranged recess;

(b) and the shaft has an axially arranged conical tip, (c) which engages in the recess of the bearing bolt.

In the vertical arrangement of the shaft, the shaft can rest loosely and freely rotatable on the bearing bolt, producing the electrical contact by its proper weight. In another configuration, the vertically arranged shaft can make contact with the bearing bolt from the bottom, whereby the pressure required to produce the electrical contact between the two surfaces can be generated by the force of a spring, for example.

In order to assure that the shaft is freely rotatable, specifically to prevent cold welding of the contact surface when the device is left standing, it is advisable to select the conical angle of the hollow conical recess somewhat larger than that of the conical tip of the counterpart. Here, it has proven to be advantageous to choose the difference between the two conical angles not smaller than 16°. A favorable combination, for example, is a conical angle of the tip not exceeding 100°, and a conical angle of the recess of the counterpart not smaler than 118°. The tip of the conical part can be advantageously shaped as a rounded segment, whose surface encloses around one fifth of the length of the adjoining conical surface of the tip. This measure specifically prevents damage to the contact bearing during the first hours of operation if the difference between the hardness of the material of the bearing bolt and the shaft is large.

If the invented contact bearings are used in process or vacuum chambers, it will usually not be necessary to have them electrically insulated. If, however, they are used e.g. to supply current to rotor windings, then the carrier, bearing bolt and rotor shaft are insulated and provided with the appropriate electrical conduit connections. The conduit connection from the contact-making surface to the rotor winding can be placed in an axial bore of the shaft with no problem, being also protected against external influences and damage.

In regard to the choice of materials of the contact-making surfaces of the bearing bolt and shaft, care should be taken that the selected materials are not prone to cold welding. For reasons of mechanical stability, moreover, it seems advantageous to have the contact-making surface of the lower-lying part (bearing bolt or shaft) in the vertical arrangement made of a harder material than that of the supported part. For this surface, specifically, special bronzes with a concentration of at least two percent by weight of beryllium and at most 0.5 percent by weight of tin have proved to be good. These can be hardened and, in such condition, the tensile strength values may reach 1400N per square mm and the Brinell hardness values (HB 30) may exceed 300. As such special bronzes also exhibit satisfactory electrical conductivity of around 12 m per ohm per square mm, they are also suitable from this standpoint for use in the invented bearings. (DIN 1782, 17666, 17672). The contact-making surface of the supported part in the vertical arrangement can be made of a softer material, in which capacity gray cast iron e.g. has proven to be suitable.

For special purposes, it may be advantageous to provide a cylindrical recess in the rotating part, in which a cylindrical part of suitable material is installed by means of a snap ring, which in turn has a hollow conical recess in its lower part.

Use of the invented current-conducting bearing in electrical appliances has demonstrated that, when the contact-making parts are made of the mentioned materials, current densities of as much as 200 amperes per square cm ($=2\times10^6$ A per square m) can be achieved at the transition between bolt and shaft. This signifies an enormous increase in the current density of the invented bearing: the permissible current load of conventional slip ring brushes of electrical machines is between 4 amperes per square cm for hard carbon and 25–30 amperes per square cm from bronze carbons (see, e.g., H. J. Schrader in *Lexikon der Physik*, Vol. 1 3rd edition, Stuttgart, 1969, p. 202).

Although the invented bearings can be used in long term operation at 300 shaft revolutions per minute with no difficulty, the preferred range of application is below 100 revolutions per minute, while in the application as substrate carrier in process chambers often only a few revolutions per minute are reached. A special field of application of the invented contact bearing lies in the high temperature region, if in addition the bearing must operate without lubrication. With the indicated materials, a long term operation of the contact bearings at temperatures up to 480° C. in the process chamber is guaranteed.

Accordingly, it is an object of the invention to provide a device for the transmission of electrical currents which comprises at least two relatively rotating machine parts having contact making surfaces which intermesh in the form of a projecting cone having a conical tip of one and a hollow cone of the other.

A further object of the invention is to provide a device for the easy transmission of electrical energy between two moving parts which is simple in design, rugged in construction and economical to manufacture.

A various features of novelty which characterize the invention are pointed with particularity in the claims annexed to and forming a part of this disclosure. For a better understanding of the invention its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
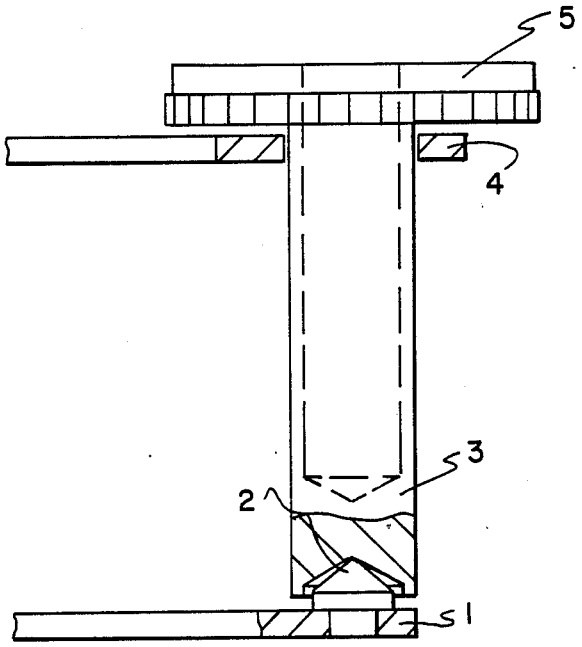
FIG. 1 is an elevational view, partly in section of a segment of a lengthwise section through a current conducting rotary plate for a process chamber such as a vacuum coating chamber constructed in accordance with the invention.

Referring to the drawings, in particular, the invention embodied therein comprises a device for the transmission of electrical currents which comprises at least two relatively movable parts which has rotating machine parts such as a bearing bolt 2 fastened to a carrier 1 and a shaft 3 supported on a second carrier 4.

In the configuration shown in FIG. 1, bearing bolt 2 with a conical tip is fastened to a carrier 1 of any given shape. On this conical part of the bearing bolt, the recess of a shaft 3, conically hollow in its outer segment, is loosely supported. The axis of this shaft corresponds with that of the bearing bolt 2 and the shaft 3 can rotate freely about this axis. In its upper part, the shaft 3 extends through a corresponding bore of a second carrier 4, whose shape is optional. The shaft 3 has an end with a support piece 5 for a substrate to be coated which is permanently fastened on this shaft 3.

Figure 2:
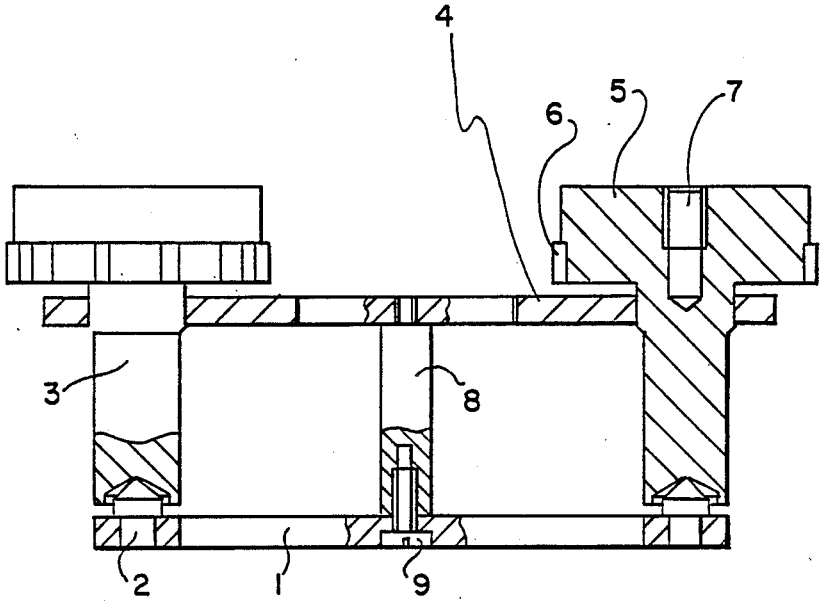
FIG. 2 is a cross-sectional through another embodiment of a current conducting rotary plate from a process chamber.

In the section through the substrate carrier of a process chamber shown in FIG. 2, there are two contact bearings as per the invention represented in a larger technical assembly. The two carriers 1 and 4, each in the shape of a circular ring, are securely joined by spacing elements or pins 8. Each element comprises a bolt or pin 8, provided with corresponding bores. The carrier 4 is secured to the carrier 1 by a screw or bolt connection 9. The carrier 1 contains a plurality of bearing bolts 2, for example 8 or 12 equally circumferentially spaced apart, on which the shafts 3 are each loosely supported. The support pieces 5 contain an additional axial bore 7 and are rotated in this configuration by the fact that projections 6 arranged on the periphery of the substrate carriers at regular intervals rotate past a fixed obstacle and impinge on it. The entire arrangement shown in FIG. 2 is current conducting and is used in a substrate coating process by the cathode sputtering method.

Figure 3:
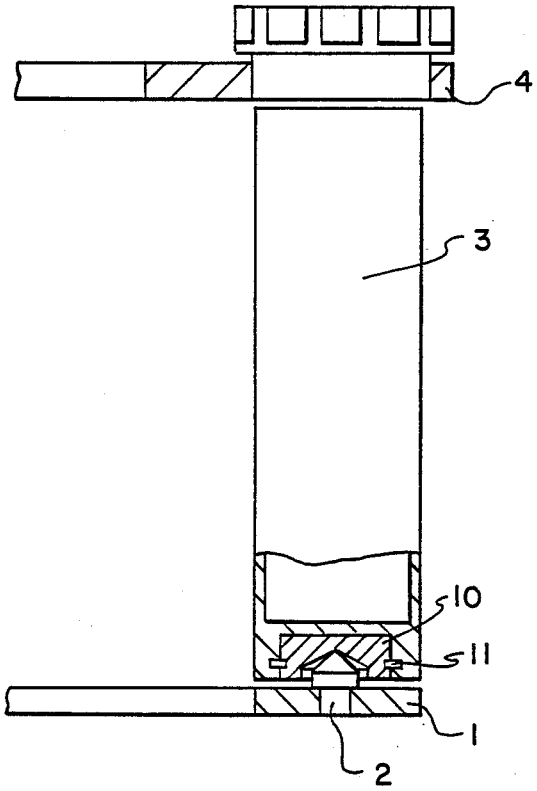
FIG. 3 is a segment of the cross-section of another embodiment of a current conducting rotary plate of a process chamber.

FIG. 3 shows another configuration of the invention, in which the rotating part or shaft 3 forms a hollow cylinder. The bottom of this cylinder, in turn, has a cylindrical recess with a circular groove in which a shaped part 10 of a different material is inserted by means of a snap ring 11. This shaped part 10, in turn, contains the conical recess which is loosely supported on the bearing bolt 2. This configuration of the invention enables a selection of the material of the shaped part 10 independent of the material of the rotor 3 and furthermore allows a replacement of this most heavily stressed part 10 without necessitating replacement of the entire rotor 3 each time.

Figure 4:
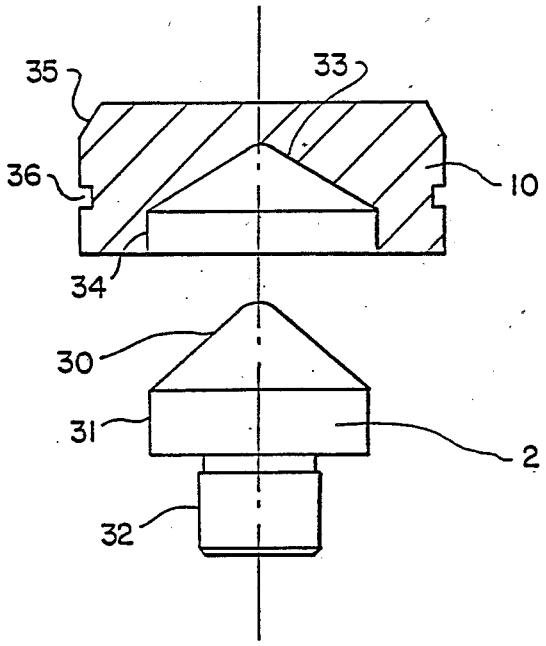
FIG. 4 is an enlarged exploded detail of FIG. 3.

FIG. 4 shows an enlarged detail from FIG. 3, containing the bearing bolt 2 and the shaped part 10 which can be inserted in the bottom of the hollow cylinder. The construction of the bearing bolt 2 from two cylindrical segments 31 and 32 and a conical tip 30, rounded into a universal ball joint at its end, can be seen from this figure. The shaped part 10, in turn, has a hollow conical recess 33 and a hollow cylindrical recess segment 34, corresponding to the respective segments of the bearing bolt. The circular groove 36 serves to fasten shaped part 10 in the bottom of the hollow cylindrical rotor and the machined margin 35 facilitates installation of the molded piece in the cylindrical recess of this bottom. In this configuration, the conical segment 30 of the bearing bolt 2 has a somewhat smaller angle of opening than the hollow conical segment 33 of the recess of the molded part 10, these angles preferably lying in the range of 100° to 120°, with a difference of around 10°.

Figure 5:
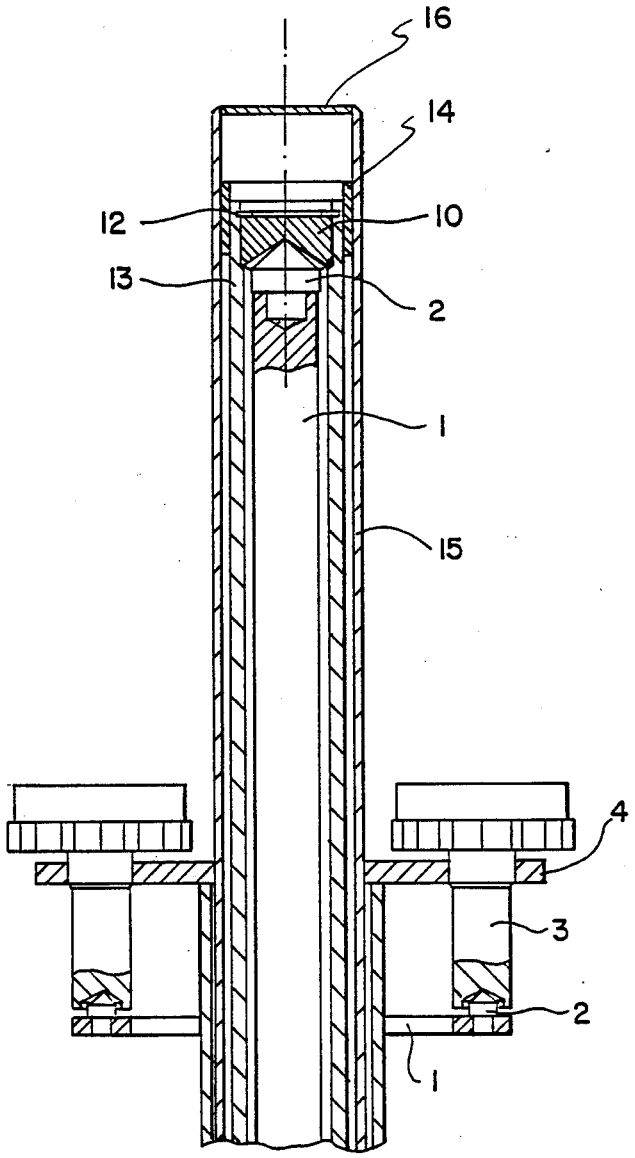
FIG. 5 is a segment of a lengthwise section through a current conducting rotary frame in a process chamber.

FIG. 5 shows a combination of several contact bearings as per the invention in the context of a rotating substrate carrier for process chambers. In the central contact bearing, the hollow conical recess is secured in the shaped part 10 by means of a snap ring 12 in an inner tube 13. This tube 13, in turn, is fastened by means of a ring bushing 14 in the outer tube 15, which is closed by the cover 16. On this outer tube 15, the two carriers 1 and 4 are permanently secured, once again displaying the shape of a circular ring in plan view. On carrier 1, a number of contact bearings 2 as per the invention are fastened, on which the shafts 3 of the substrate carrier are supported in free rotation. The overall arrangement according to this configuration of the invention is placed inside a process chamber and is current conducting.

Figure 6:
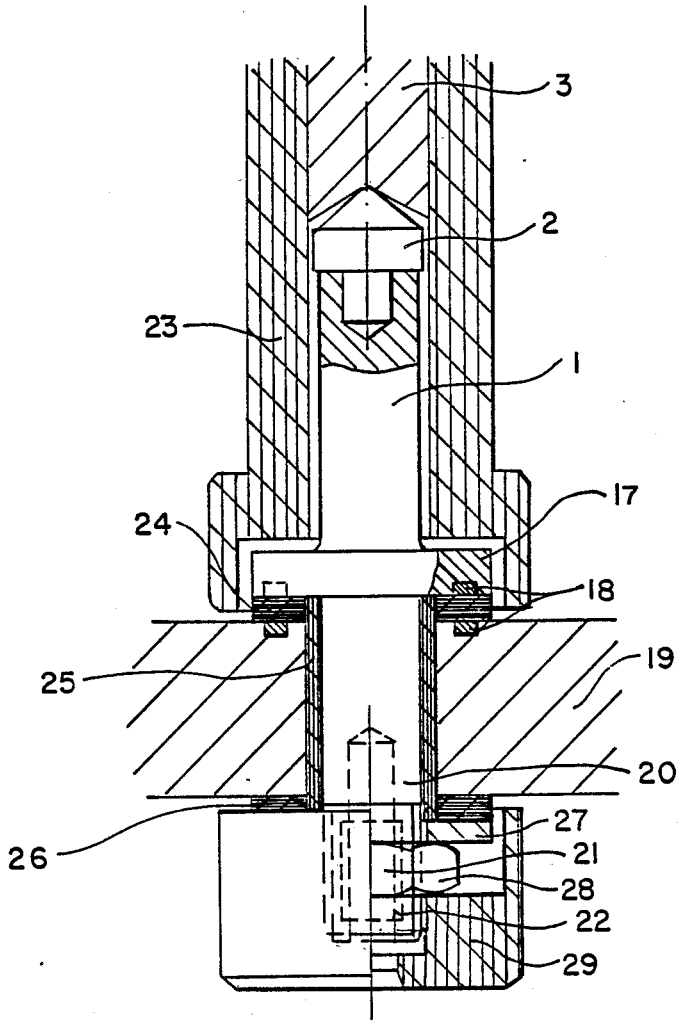
FIG. 6 is a lengthwise section through an electrically insulated configuration of a contact bearing as per the invention.

FIG. 6 shows a lengthwise section through an electrically insulated device according to the invention, as can be used for example to supply current to the rotor windings of electric motors. In this configuration of the invention, the current conducting bearing bolt 2 is secured on a cylindrical carrier 1. This carrier is provided with a circular annular flange 17 which is supported on the base plate 19 across an insulating ring 24 with corresponding seals 18. The part 20 of this cylindrical carrier is led through a bore of the base plate 19, which is closed off by an insulating sleeve 25 and an additional insulating ring 26. This part 20 has a threading at its end and is screwed tight to the other end of the base plate 19 by means of a screw nut 27,28 placed underneath. Furthermore, it has an axial bore 21 with contact lamination 22 to receive a plug and is closed with a cover 29 of standard design.

While a specific embodiment of the invention has been shown and described in detail to illustrate the application of the principals of the invention, it will be understood that the invention may be embodied otherwise without departing from such principals.

What is claimed is:

1. A substrate arrangement for carrying an element to be coated, comprising:

a first support carrier;

a second support carrier spaced from said first carrier;

a first machine part formed of metal and having a first contact-making surface, said first contact-making surface being one piece with said first machine part and being shaped in the form of a conical tip;

a second machine part made of metal and having a second contact-making surface, said second contact-making surface being one piece with said second machine part and being shaped in the form of a conical recess, said second machine part extending through a bore of said second carrier and supporting a substrate carrier on a side of said second carrier opposite said first carrier, said first and second machine parts being rotatably arranged relative to each other about a rotational axis, said first contact-making surface being engaged with said second contact-making surface, said conical tip of said first machine part having a major axis coinciding with said rotational axis, said conical recess of said second part having a major axis coinciding with said rotational axis, said conical recess of said second machine part having a larger conical angle than said conical tip of said first machine part, said first and second contact-making surfaces defining an electrical connection connected to said substrate carrier having a current density of at least 50 amperes per $cm^2$.

2. A device according to claim 1, wherein said electrical connection has a current density of as much as 200 amperes per $cm^2$.

3. A device according to claim 1, wherein at least one of said first and said second machine parts are formed of a bronze alloy of at least 2% by weight beryllium and up to 0.5% by weight of tin.

4. A device according to claim 1, wherein at least one of said first and second machine parts has a tensile strength up to 1,400N per square mm.

5. A device according to claim 1, wherein said first machine part comprises a bearing bolt having an axially arranged conical tip, and said second machine part comprises a rotating shaft having an axially arranged conical recess in which said conical tip of said bearing bolt engages.

6. A device according to claim 5, wherein said shaft is vertically arranged and rests loosely on and is freely rotatable on said bearing bolt.

7. A device according to claim 5, wherein said shaft is vertically arranged and has a lower end making contact with said bearing bolt.

8. A device according to claim 5, wherein the difference between the conical angle of said recess and the conical angle of said tip is at least 16°.

9. A device according to claim 5, wherein said conical angle of said recess is at least 118° and that of said tip is no greater than 100°.

10. A device according to claim 5, wherein said contact-making conical tip comprises a rounded segment.

11. A device according to claim 5, wherein said bearing bolt contact surface is made of a material harder than that of said rotating shaft.

12. A device according to claim 5, wherein said contact-making surface of said rotating shaft is made of a material harder than that of said bearing bolt.

13. A device according to claim 11, wherein said harder material part comprises a special bronze with a concentration of at least 2% by weight of beryllium and not over 0.5% by weight of tin.

14. A device according to claim 12, wherein the softer material of said rotating shaft comprises a gray cast iron.

* * * * *